United States Patent [19]

Smith et al.

[11] 4,221,174

[45] Sep. 9, 1980

[54] DIRECT IGNITION OF A FLUCTUATING FUEL STREAM

[75] Inventors: Donald A. Smith, Haddam; Richard C. LaFlesh, Enfield, both of Conn.

[73] Assignee: Combustion Engineering Inc., Windsor, Conn.

[21] Appl. No.: 906,689

[22] Filed: May 16, 1978

[51] Int. Cl.[3] ..... F23C 11/00; F23D 1/00

[52] U.S. Cl. ..... 110/265; 110/347; 110/263; 431/1

[58] Field of Search ..... 431/1; 110/265, 263, 110/347

[56] References Cited

U.S. PATENT DOCUMENTS

| | | | |
|---|---|---|---|
| 2,945,459 | 7/1960 | Junkermann | 431/1 |
| 3,250,236 | 5/1966 | Zelinski | 110/265 |
| 3,606,867 | 9/1971 | Briffa | 431/1 |
| 3,738,290 | 6/1973 | Belter | 431/1 |

*Primary Examiner*—Edward G. Favors

[57] ABSTRACT

A method of direct ignition of pulverized coal to furnish energy for warm-up or low load operation of a coal burning furnace comprises forming a fuel stream consisting of a mixture of pulverized coal and air, the fuel stream having an air to coal ratio and/or a flow velocity which fluctuates. The fluctuating fluid stream is introduced into a combustion area where the coal is ignited by an energy source. The fluctuation of the air to coal ratio and/or the fluctuation of the flow speed provide for the air to coal ratio and/or the flow speed to be swept through a range of values which includes the optimum conditions for ignition.

24 Claims, 3 Drawing Figures

DIRECT IGNITION OF A FLUCTUATING FUEL STREAM

BACKGROUND OF THE INVENTION (1) Field of the Invention

The present invention relates to burners designed for the combustion of pulverized coal and, more particularly, to burners utilized in coal-fired boilers of steam generators used in electric utility plants. This invention is also directed to a method for igniting pulverized coal to furnish energy for warm-up or low load operation of a coal burning furnace. Accordingly, the general objects of the present invention are to provide novel and improved apparatus and methods of such character.

(2) Description of the Prior Art

Because of the increasing cost of and reduction in the availability of natural gas and oil, it is becoming increasingly desirable to use coal in facilities which generate electricity. However, even conventional coal-fired steam generator boilers of the type used by electric utilities require large quantities of natural gas or oil to furnish energy for warm-up or low load operation. The required amount of these auxiliary premium fuels is significant and, for example, the use of 70,000 gallons of oil to start up a 500 megawatt electric utility unit is not uncommon.

Accordingly, it is an object of the present invention to provide for direct ignition of pulverized coal to furnish energy for warm-up or low load operation of a coal burning furnace.

SUMMARY OF THE INVENTION

The present invention provides for the direct ignition of a fuel stream of pulverized coal and air. In accordance with the invention, a fuel stream comprising a mixture of pulverized coal and air is formed. The fuel stream has an oxygen-to-coal ratio and/or a velocity which is caused to fluctuate such that these parameters are swept through a range of values which include the optimum conditions for ignition. The fluctuating or undulated fuel stream is introduced into a combustion area where energy is delivered to the fluid stream to ignite the coal.

In the preferred embodiment of the invention a fuel stream comprising a mixture of pulverized coal and air is formed. In the preferred embodiment, a source of gas having a fluctuating mass flow rate is injected into the fluid fuel stream to provide a mixture having an oxygen-to-coal ratio and/or a velocity which fluctuates at a predetermined frequency whereby the fuel stream is repetitively swept through a range of values of these parameters which includes the optimum ignition value of these parameters.

BRIEF DESCRIPTION OF THE DRAWINGS

The present invention may be better understood and its numerous objects and advantages will become apparent to those skilled in the art by reference to the accompanying drawing wherein like reference numerals refer to like elements in the several figures and in which.

DETAILED DESCRIPTION OF THE INVENTION

Figure 1:
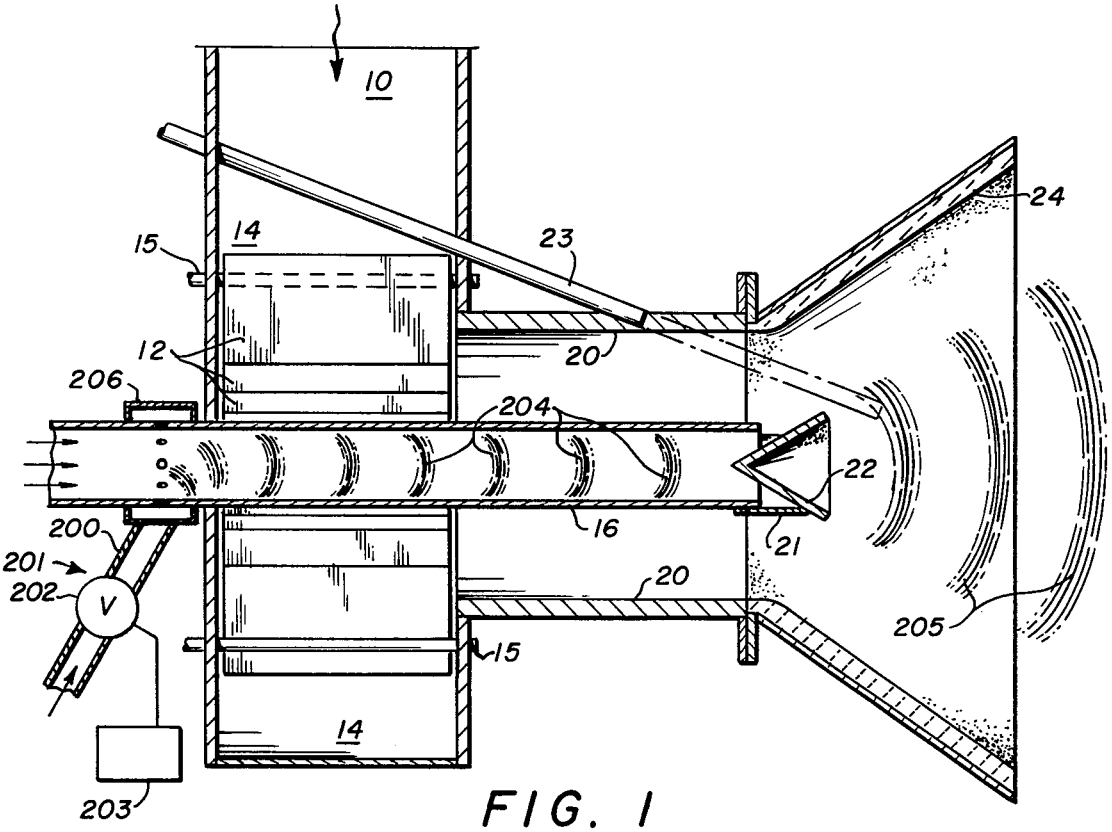
FIG. 1 is a cross-sectional view of an arc-ignited pulverized coal burner which may be employed in the practice of the present invention.

With reference to FIG. 1, a burner in accordance with the present invention is shown. Coal pipe 16 is employed to convey coal pneumatically to the ignition zone in the burner. Accordingly, as the apparatus is shown in FIG. 1, the left end of coal pipe 16 is in communication with the coal feeder of FIGS. 2 and 3 while the right end of coal pipe 16 terminates at hollow-cone diffuser 22 which is mounted from coal pipe 16 by supports 21. Igniter 23 is positioned immediately downstream of the discharge end of coal pipe 16. Igniter 23 enters through the side of the burner and in the disclosed embodiment comprises a high-energy arc igniter similar to the type presently used for igniting oil. It is to be noted that any ignition source which imparts sufficient energy to heat the reactants enough to ignite them may be used. Accordingly, a resistance heater or small fossil fueled pilot torch could be employed in place of the high energy arc igniter. The high energy arc igniter is, however, preferred because of its reliability and controllability. Igniter 23, as shown in FIG. 1, will typically be retractably mounted so that it can be removed from the combustion zone into a protective area after the coal has been ignited.

The burner also includes a secondary air supply conduit 20 which is coaxial with coal pipe 16. Conduit 20 communicates, at its upstream end, with air chamber 14 which will typically be a cylindrical chamber somewhat larger in diameter than that of conduit 20. Air chamber 14 contains a plurality of vanes 12. Vanes 12 are arranged to impart a swirl to air entering conduit 20 from chamber 14. An air inlet duct 10 leads to air chamber 14 from a pressurized air supply, not shown. Air conduit 20 terminates in a divergent nozzle which may be a refractory-lined cone 24. In one reduction to practice of the invention, coal pipe 16 had a one inch inner diameter, conduit 20 had a six inch inner diameter and nozzle 24 has a thirteen inch diameter at its open end and an angle of divergence of 35°.

Figure 2:
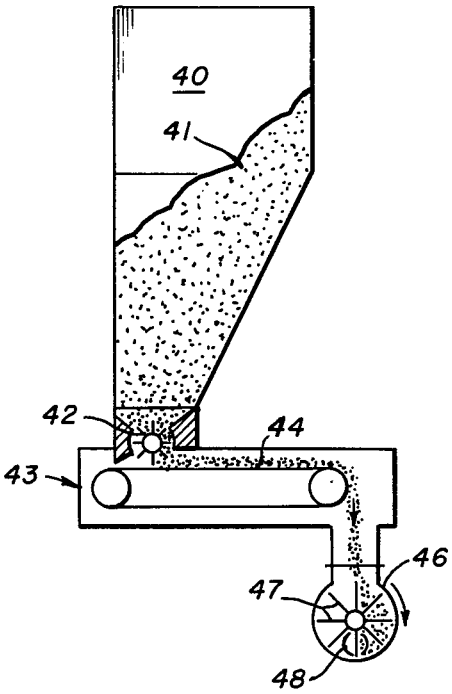
FIG. 2 is a cross-sectional view of a pulverized coal feed system which may be associated with the burner of FIG. 1.
Figure 3:
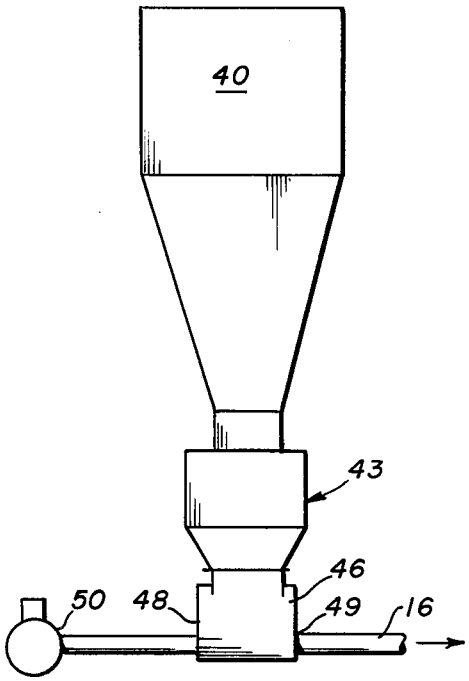
FIG. 3 is a front elevation view of the feeder system of FIG. 2.

FIGS. 2 and 3, which will be discussed simultaneously, show a pulverized-coal feed system for supplying a coal-air mixture to coal pipe 16. The feed system includes a pulverized-coal hopper 40 that can be supplied by any of a number of means known in the art. Preferably, hopper 40 should be sized to store sufficient pulverized coal to supply the burner throughout the warm-up period of the furnace in which the burner is to be used. Hopper 40 communicates with a gravimetric feeder indicated generally at 40. Feeder 43 will typically include a variable-speed feed mechanism 42, a conveyor 44 and appropriate control circuitry, not shown. The speed of rotation of feed mechanism 42 may be varied to control the amount of coal allowed to drop onto conveyor 44. Conveyor 44 may be a weight-sensitive feed mechanism, and the weight sensed by load cells associated with conveyor 44 may be employed to control the speed of movement of the conveyor. Gravimetric feeder 43 introduces coal into a rotary air-lock 46 at a constant rate.

Rotary air-lock 46 comprises a cylindrical chamber with blades 47 that approach an air-tight fit with the chamber inner wall. At the bottom of the chamber are oppositely disposed but axially aligned air entrance opening 48 and fuel stream exit opening 49, exit opening 49 being coupled to the fuel receiving end of coal pipe 16. The fit of blades 47 is such that there is almost no free air path between openings 48 or 49 amd feeder 43. Accordingly, it is possible for an air stream entering opening 48 to continue out through opening 49 without being deflected into gravimetric feeder 43. The rotation of blades 47 carries pulverized coal dropped onto blades 47 by gravimetric feeder 43 into the air path between openings 48 and 49. Compressed air is supplied to feeder 46 by an appropriate source 50 at a controlled rate whereby a coal-air mixture having a predetermined air-to-coal weight ratio will be supplied through pipe 16 to the burner. The air-to-coal weight ratio will be in the dense phase regime; i.e., a ratio of 1:1 or less will be employed.

In order to operate the burner of FIG. 1, igniter 23 is moved to its inserted position and energized. In one reduction to practice utilizing an arc igniter, sparks having an energy contact of approximately 30 joules, lasting about 10 microseconds each, and having a repetition rate of 10 Hertz have been successfully employed. The energy content of the ignition energy source, and the spark duration and repetition rate in the case of a high energy arc, will vary as a function of fuel ignitability which, in turn, is primarily a function of coal particle size, fuel stream velocity and oxygen/fuel ratio in the ignition zone. Fuel ignitability is also, to a lesser extent, a function of the moisture, volatiles and ash content and the agglomerating tendencies of the coal.

The burner of FIG. 1 can be used as a warm-up burner for utility boilers. In utility-boiler operation, it is necessary for the boiler to be brought to an elevated temperature in order for its conventional coal burners to work properly. The burners of the present invention can be used to bring the furnace up to a temperature high enough for stable combustion in conventional burners. The present invention can also be used for both ignition and low-load stabilization.

It should be understood that the ability of the above-described burner to ignite the coal and air mixture discharged from pipe 16 is dependent upon a number of parameters. These parameters include, in addition to the ignitability of the fuel stream provided through pipe 16 as discussed above, the temperature of the mixture and the particle size distribution of the coal in the mixture. There exists particular sets of these parameters at which ignition will be most likely to occur. It should be understood that it is difficult to achieve the optimum set of parameters for ignition because during any given ignition sequence the source of coal may have an inconsistent energy content and/or an inconsistent particle size distribution. Moreover, some of the parameters which effect ignition probability are outside the control of the operator of the burner. These uncontrollable parameters include the relative humidity and temperature of the ambient air and the type of coal available.

Thus, it would be desirable if, during any given ignition process, the optimum achievable ignition parameters are periodically provided to insure that ignition will occur. Once optimum conditions for ignition are met, if only momentarily, the ignited coal will ignite the fuel mixture in close proximity thereto even though the mixture may not meet the optimum condition for ignition.

In accordance with the present invention the oxygen-to-coal weight ratio of the fuel mixture delivered to the ignition zone is caused to sweep through a range of values which includes the optimum ignition value presuming that the other variables are uncontrolled but remain within acceptable limits. To this end, a fluctuating source of gas, indicated generally at 201, is provided upstream of the ignition area. Source 201 comprises a supply of gas at a varying mass flow rate. Preferably, the fluctuation in mass flow rate should have a predetermined frequency. The gas furnished by source 201, while typically air, may also be oxygen or an inert gas such as nitrogen. It should be understood that, as the fluctuating mass of air or other gas is injected into the coal and air mixture flowing through pipe 16, the velocity of the mixture in pipe 16 also fluctuates. This fluctuation of the carrier gas-to-coal weight ratio, and most importantly the oxygen content thereof, and/or the speed of the fuel mixture, results in the oxygen-to-coal weight ratio and the velocity of the fuel stream in the ignition zone being swept through ranges of values which include the optimum ignition values.

As shown in FIG. 1, source 201 supplies gas from a pressurized source, not shown, through solenoid operated valve 202 to pipe 200. The downstream end of pipe 200 terminates in a manifold or plenum chamber 206 which extends about fuel pipe 16. Within manifold 206 the fuel pipe is provided with a plurality of apertures which are shaped, sized and spaced to provide gas jets which penetrate to the center of pipe 16. The design of the apertures in pipe 16 will take into account the desirability of avoiding a variation in fuel stream density in the radial direction; i.e., the density variations which are desired should preferredly be substantially uniform across the fuel pipe and spaced in time as indicated schematically at 204. Thus, in operation, pulses of gas delivered from valve 202 to pipe 200 are injected into pipe 16 upstream of the ignition zone. Signal generator 203 provides a variable frequency energizing signal to the solenoid of valve 202 which results in the opening and closing of the valve at a predetermined frequency to provide surges of gas at this predetermined frequency. The variations in fuel stream density resulting from injection of the surges of gas are, as noted above, indicated generally by reference character 204. When the gas in pipe 200 is mixed with the dense phase fuel mixture in pipe 16, a stream having a fluctuating coal-to-oxygen ratio is provided.

The present invention also takes into account the fact that the conditions of optimum ignition probability, and particularly the oxygen available in the ignition zone, differ from the conditions necessary to optimize the propagation of flame through the fuel-air mixture. Less air is required for optimum ignition than is needed for flame propagation and sweeping the air-to-coal weight ratio enables approaching optimization of both conditions.

Also in accordance with the invention, when an arc igniter is employed the spark frequency will be different than, and preferably greater than, the frequency of operation of valve 202 to insure that the ignition energy is not always supplied at the same point in the variation cycle of the density of the fuel stream.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. An apparatus for causing ignition and sustaining combustion of pulverized coal in a combustion area including: means for forming a fuel stream comprising a dense phase mixture of pulverized coal and air; means for injecting a gas into the fuel stream to cause a periodic variation in the density of said fuel stream; means for introducing the varying density fuel stream into the combustion area; an ignitor positioned in the combustion area for delivering ignition energy to the fuel stream; and means for delivering secondary air to the combustion area coaxially of the fuel stream to support combustion thereof subsequent to ignition.

2. The apparatus of claim 1 wherein the means for injecting a gas comprises:

a variable pressure gas source, said variable pressure source including controllable valve means;

means for injecting gas into the fuel stream at a plurality of points spaced circumferentially around the fuel stream approximately in a plane oriented transversely of the axis of the fuel stream; and means coupling said source to said injecting means.

3. The apparatus of claim 2 wherein said igniter comprises means for establishing an intermittent electrical discharge in the combustion area.

4. The apparatus of claim 3 further comprising:

means for controlling the frequency of operation of said gas source valve means whereby the rate of variation of fuel stream density will differ from the rate of establishment of an electrical discharge in the combustion area.

5. The apparatus of claim 4 wherein said gas source supplies air and wherein said forming means provides a fuel stream having an air-to-coal weight ratio below approximately 1.0 prior to introduction of the stream into the combustion area whereby the air-to-coal weight ratio will be varied through a range which encompasses the optimum conditions for ignition for the coal type and ambient conditions.

6. A method for causing ignition of pulverized coal in a combustion area comprising the steps of:

forming a fuel stream comprising a mixture of pulverized coal entrained in air;

injecting a gas into a formed fuel stream at a predetermined frequency to cause the oxygen-to-coal weight ratio of the fuel stream to vary through a range; and creating a periodic electrical discharge in the combustion area to deliver ignition energy to the fuel stream, the electrical discharge being controlled to occur at a frequency which differs from the rate of variation of the fuel stream oxygen-to-coal weight ratio as determined by the frequency at which the gas is injected into the formed fuel stream.

7. A method for causing ignition of pulverized coal in a combustion area comprising the steps of:

forming a fuel stream comprising a mixture of pulverized coal entrained in air:

injecting air into the formed fuel stream at a predetermined frequency to provide a mixture having an air-to-coal weight ratio which varies at said predetermined frequency over a range which includes the optimum conditions for ignition and for flame propagation for the coal type and ambient conditions, said air-to-coal weight ratio not exceeding 1.0 prior to introduction of the mixture into the combustion area;

injecting the mixture into the combustion area; and intermittently delivering ignition energy to the mixture in the combustion area to ignite the coal.

8. The method of claim 7 wherein the step of intermittently delivering ignition energy comprises;

establishing an electrical discharge in the combustion area at a frequency which differs from the said predetermined frequency of variation of the mixture of air-to-coal weight ratio.

9. The method of claim 8 further comprising the step of controlling the velocity of the mixture to be within the range of 75–125 ft/sec at the time of injection into the combustion area.

10. A method for reliably igniting pulverized coal in a combustion area comprising the steps of:

forming a fuel stream comprising a mixture of pulverized coal entrained in a carrier gas;

injecting a gas into the formed fuel stream at a predetermined frequency to provide a mixture having a density which fluctuates;

introducing the fuel stream into the combustion area;

delivering ignition energy to the fuel stream in the combustion area to ignite the coal; and delivering secondary air to the combustion area coaxially of the fuel stream to support combustion thereof.

11. A method according to claim 10 wherein the oxygen-to-coal weight ratio is varied through a range which approaches the optimum conditions for ignition and for flame propagation for the coal type and ambient conditions.

12. A method according to claim 11 wherein the velocity of the fuel stream also varies.

13. The method of claim 12 wherein the velocity of the mixture is controlled to be within the range of 75 to 125 ft/sec at the time of introduction into the combustion area.

14. A method according to claim 13 wherein the injected gas is air and the air-to-coal weight ratio is below approximately 1.0 prior to introduction of the mixture into the combustion area.

15. The method of claim 14 wherein the ignition energy is intermittently delivered at a frequency greater than the fuel stream density fluctuation.

16. The method of claim 11 wherein the ignition energy is intermittently delivered at a frequency greater than the fuel stream density fluctuation.

17. The method of claim 15 wherein the injected gas is air.

18. The method of claim 10 wherein the step of delivering ignition energy to the fuel stream comprises:

establishing an intermittent electrical discharge in the combustion area.

19. The method of claim 10 wherein the velocity of the fuel stream also varies through a range.

20. The method of claim 10 wherein the step of injecting a gas into the fuel stream includes maintaining the air-to-coal weight ratio of the fuel stream below approximately 1.0 prior to introduction of the fuel stream into the combustion area.

21. A method for reliably igniting pulverized coal in a combustion area comprising the steps of:

forming a fuel stream comprising a mixture of pulverized coal entrained in a carrier gas;

causing the oxygen-to-coal weight ratio of the fuel stream to periodically vary through a range;

introducing the fuel stream into the combustion area;

maintaining the velocity of the fuel stream within the range of 75–125 ft/sec at the time of introduction into the combustion area;

delivering ignition energy to the fuel stream in the combustion area to ignite the coal; and delivering secondary air to the combustion area coaxially of the fuel stream to support combustion thereof.

22. The method of claim 21 wherein the step of delivering ignition energy to the fuel stream comprises:

establishing an intermittent electrical discharge in the combustion area.

23. The method of claim 21 wherein the velocity of the fuel stream varies within said range as the oxygen-to-coal weight ratio of the fuel stream varies.

24. A method according to claim 21 wherein the oxygen-to-coal weight ratio is varied through a range which approaches the optimum conditions for ignition and for flame propagation for the coal type and ambient conditions.

* * * * *